US007596950B2

(12) United States Patent
Woltmann et al.

(10) Patent No.: US 7,596,950 B2
(45) Date of Patent: Oct. 6, 2009

(54) AUGMENTOR RADIAL FUEL SPRAY BAR WITH COUNTERSWIRLING HEAT SHIELD

(75) Inventors: Ivan Elmer Woltmann, West Chester, OH (US); Thurmond Douglas Senter, Mason, OH (US); Lawrence Paul Timko, Fairfield, OH (US)

(73) Assignee: General Electric Company, Schenectady, NY (US)

( * ) Notice: Subject to any disclaimer, the term of this patent is extended or adjusted under 35 U.S.C. 154(b) by 506 days.

(21) Appl. No.: 11/228,793

(22) Filed: Sep. 16, 2005

(65) Prior Publication Data

US 2007/0220893 A1 Sep. 27, 2007

(51) Int. Cl.
*F02K 3/10* (2006.01)

(52) U.S. Cl. ..... 60/765; 60/761

(58) Field of Classification Search ..... 60/761–766
See application file for complete search history.

(56) References Cited

U.S. PATENT DOCUMENTS

| | | | | |
|---|---|---|---|---|
| 3,800,530 | A * | 4/1974 | Nash | 60/761 |
| 4,887,425 | A * | 12/1989 | Vdoviak | 60/761 |
| 4,901,527 | A | 2/1990 | Nash et al. | |
| 5,251,447 | A * | 10/1993 | Joshi et al. | 60/737 |
| 5,297,391 | A | 3/1994 | Roche | |
| 5,335,490 | A | 8/1994 | Johnson et al. | |
| 5,396,761 | A | 3/1995 | Woltmann et al. | |
| 5,396,763 | A | 3/1995 | Mayer et al. | |
| 5,400,589 | A | 3/1995 | Mahias et al. | |
| 5,813,221 | A | 9/1998 | Geiser et al. | |
| 6,415,609 | B1 | 7/2002 | Vacek et al. | |
| 6,463,739 | B1 | 10/2002 | Mueller et al. | |
| 6,668,541 | B2 | 12/2003 | Rice et al. | |
| 2002/0085448 | A1 * | 7/2002 | Phillips | 366/181.5 |
| 2006/0016193 | A1 * | 1/2006 | Roche et al. | 60/761 |
| 2006/0032231 | A1 * | 2/2006 | Andersson et al. | 60/765 |

OTHER PUBLICATIONS

"Full Speed In The Warehouse", News, Views & Interviews, AERO, No.2 / 2003, 5 pages.

"F-110-GE-132: Enhanced Power Through Low-Risk Derivative Technology", A.R. Wadia, F.D. James, Transactions of the ASME, vol. 123, Jul. 2001, pp. 544-551.

* cited by examiner

*Primary Examiner*—Michael Cuff
*Assistant Examiner*—Phutthiwat Wongwian
(74) *Attorney, Agent, or Firm*—William Scott Andes; Steven J. Rosen

(57) ABSTRACT

A gas turbine engine augmentor radial fuel spray bar has a counterswirling spray bar heat shield. Two embodiments of the heat shield include one with a cambered airfoil cross-section and another with a twisted airfoil cross-section and may have varying or constant degree of camber or twist, respectively, along a radial length of the spray bar heat shield. The spray bar may have one or more spray bar fuel tubes within the heat shield, openings in the heat shield, and fuel holes in the tubes operable for injecting fuel through the openings. A gas turbine engine augmentor having a plurality of circumferentially spaced apart radial flameholders may incorporate a plurality of the augmentor radial fuel spray bars with one or more of the augmentor radial fuel spray bars circumferentially disposed between one or more circumferentially adjacent pairs of the radial flameholders.

22 Claims, 7 Drawing Sheets

AUGMENTOR RADIAL FUEL SPRAY BAR WITH COUNTERSWIRLING HEAT SHIELD

The Government has rights to this invention pursuant to Contract No. N00019-96-C-0176 awarded by the United States Department of Defense.

BACKGROUND OF THE INVENTION

The present invention relates generally to aircraft gas turbine engine augmentors and, more specifically, to radial flameholders and spray bars in the augmentor.

High performance military aircraft typically include a turbofan gas turbine engine having an afterburner or augmentor for providing additional thrust when desired. The turbofan engine includes, in serial flow communication, a multistage fan, a multistage compressor, a combustor, a high pressure turbine powering the compressor, and a low pressure turbine powering the fan. During operation, air is compressed in turn through the fan and compressor and mixed with fuel in the combustor and ignited for generating hot combustion gases which flow downstream through the turbine stages which extract energy therefrom. The hot core gases are then discharged into an augmentor from which they are discharged from the engine through a variable area exhaust nozzle.

The augmentor includes an exhaust casing and a liner therein circumscribing a combustion zone. Fuel spray bars and flameholders are axially located between the turbines and an exhaust nozzle at a downstream end of the combustion zone for injecting additional fuel when desired during reheat, thrust augmentation, or afterburning operation for burning in the augmentor combustor for producing additional thrust. Augmentor operation includes fuel injection into an augmentor combustion zone and ignition is initiated by some type of spark discharge or other igniter or auto-ignition due to hot core gases. Since the rate of gas flow through an augmentor is normally much greater than the rate of flame propagation in the flowing gas, some means for stabilizing the flame is usually provided, else the flame will simply blow out the rear of the engine, and new fuel being injected will not be ignited.

Various types of flameholders are used for stabilizing the flame and typically have included circumferential V-shaped gutters which provide stagnation regions there behind of local low velocity regions in the otherwise high velocity core gases for sustaining combustion during reheat operation. Radial spray bars have typically been used for injecting fuel for thrust augmentation.

In regions immediately downstream of the flameholder, the gas flow is partially recirculated and the velocity is less than the rate of flame propagation. In these regions, there will be a stable flame existing which can ignite new fuel as it passes. Unfortunately, flameholders in the gas stream inherently cause flow losses and reduced engine efficiency. Several modern gas turbine engine's and designs include radially extending spray bars and flameholders in an effort to improve flame stability and reduce the flow losses. Radial spray bars integrated with radial flameholders are disclosed in U.S. Pat. Nos. 5,396,763 and 5,813,221. Radial spray bars disposed between radial flameholders having integrated radial spray bars have been incorporated in the GE F414 and GE F110-132 aircraft gas turbine engines. This arrangement provides additional dispersion of the fuel for more efficient combustion and unload fueling of the radial flameholders with the integrated radial spray bars so that they do not blowout and or have unstable combustion due to excess fueling.

High levels of swirl may be produced in the exhaust flow downstream of the engine's turbines. Flow deflected off highly angled sides of radial flameholders impart considerable swirl to the exhaust flow and this imparted swirl is detrimental to thrust and stable combustion. Thus, it is highly desirable to have an augmentor or afterburner that can produce a stable flame and holding down thrust and flow losses due to swirl produced downstream of the turbines.

SUMMARY OF THE INVENTION

A gas turbine engine augmentor radial fuel spray bar has a counterswirling spray bar heat shield. The spray bar heat shield may be operable to counterswirl of an inlet flow having an inlet flow swirl angle resulting in an outlet flow swirl angle being substantially 0 degrees and an outlet flow substantially parallel to an augmentor centerline axis. The counterswirling spray bar heat shield may have a cambered airfoil cross-section pressure and suction sides and the cambered airfoil cross-section may have a varying or constant degree of camber along a radial length of the spray bar heat shields. The counterswirling spray bar heat shield may have a twisted airfoil with a twisted airfoil cross-section and a twist with a varying or constant degree of twist along a radial length of the spray bar heat shields. One or more spray bar fuel tubes may be disposed within the counterswirling spray bar heat shield. Fuel holes in the spray bar fuel tubes are operable for injecting fuel through openings in the spray bar heat shield.

A gas turbine engine augmentor having a plurality of circumferentially spaced apart radial flameholders may incorporate a plurality of the augmentor radial fuel spray bars with one or more of the augmentor radial fuel spray bars disposed between one or more circumferentially adjacent pairs of the radial flameholders. A more particular embodiment of the augmentor includes only one of the augmentor radial fuel spray bars circumferentially disposed between each of the circumferentially adjacent pairs of the radial flameholders.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
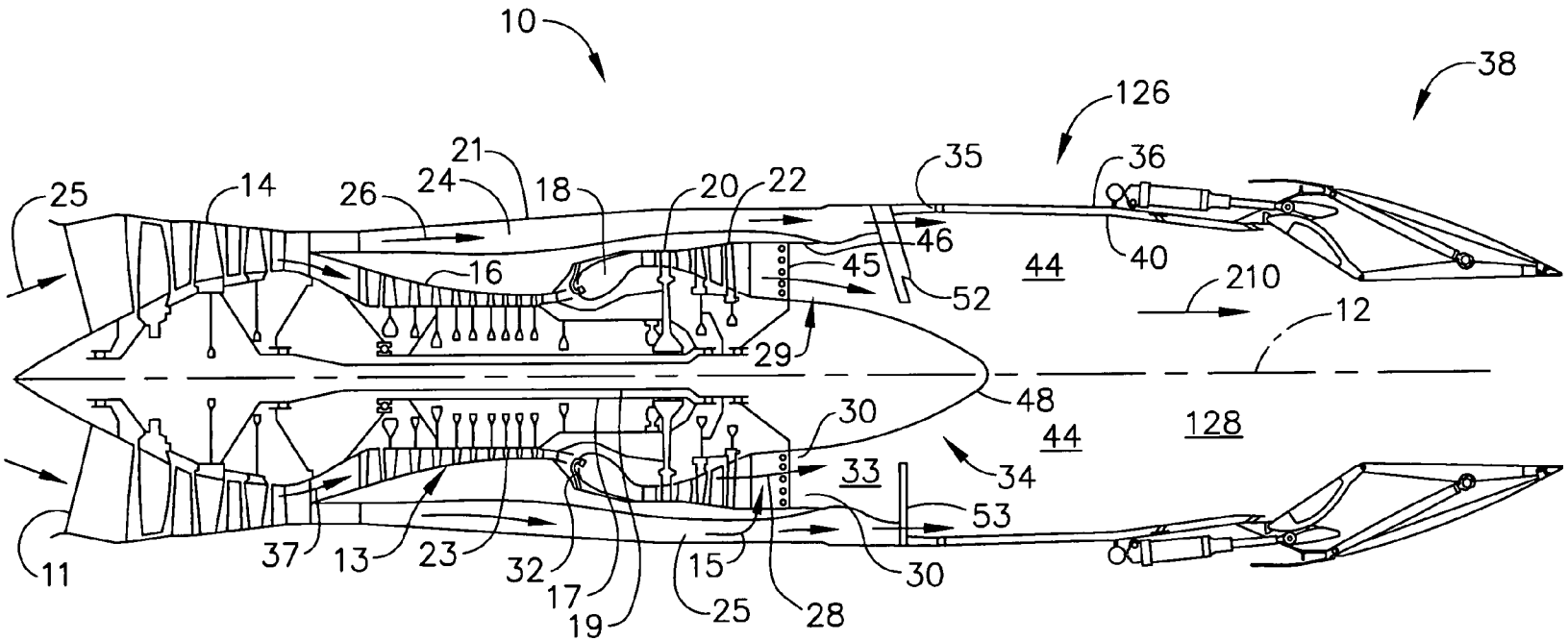
FIG. 1 is an axial sectional view illustration through an exemplary turbofan gas turbine engine having an augmentor with radial spray bars including counterswirling heat shields.

Illustrated in FIG. 1 is an exemplary medium bypass ratio turbofan gas turbine engine 10 for powering an aircraft (not shown) in flight. The engine 10 is axisymmetrical about a longitudinal or axial centerline axis 12 and has a fan section 14 upstream of a core engine 13. The core engine 13 includes, in serial downstream flow communication, a multistage axial high pressure compressor 16, an annular combustor 18, and a high pressure turbine 20 suitably joined to the high pressure compressor 16 by a high pressure drive shaft 17. Downstream of the core engine 13 is a multistage low pressure turbine 22 suitably joined to the fan section 14 by a low pressure drive shaft 19. The core engine 13 is contained within a core engine casing 23 and an annular bypass duct 24 containing a bypass flowpath 25 circumscribed about the core engine 13. An engine casing 21 circumscribes the bypass duct 24 which extends from the fan section 14 downstream past the low pressure turbine 22.

Engine air enters the engine through an engine inlet 11 and is initially pressurized as it flows downstream through the fan section 14 with an inner portion thereof referred to as core engine air 37 flowing through the high pressure compressor 16 for further compression. An outer portion of the engine air is referred to as bypass air 26 and is directed to bypass the core engine 13 and flow through the bypass duct 24. The core engine air is suitably mixed with fuel by fuel injectors 32 and carburetors in the combustor 18 and ignited for generating hot combustion gases which flow through the turbines 20, 22. The hot combustion gases are discharged through an annular core outlet 30 as core gases 28 into an exhaust flowpath 128 extending downstream and aftwardly of the turbines 20, 22 and through a diffuser 29 which is aft and downstream of the turbines 20, 22 in the engine 10.

The diffuser 29 includes a diffuser duct 33 circumscribed by an annular radially outer diffuser liner 46 and is used to decrease the velocity of the core gases 28 as they enter an augmentor 34 of the engine. The centerline axis 12 is also the centerline axis of the augmentor 34 which is circumferentially disposed around the centerline axis 12. A converging centerbody 48 extending aft from the core outlet 30 and partially into the augmentor 34 radially inwardly bounds the diffuser duct 33. The diffuser 29 is axially spaced apart upstream or forwardly of a forward end 35 of a combustion liner 40 inside the exhaust casing 36. Thus, the combustion zone 44 is located radially inwardly from the bypass duct 24 and downstream and aft of the augmentor 34.

Figure 2:
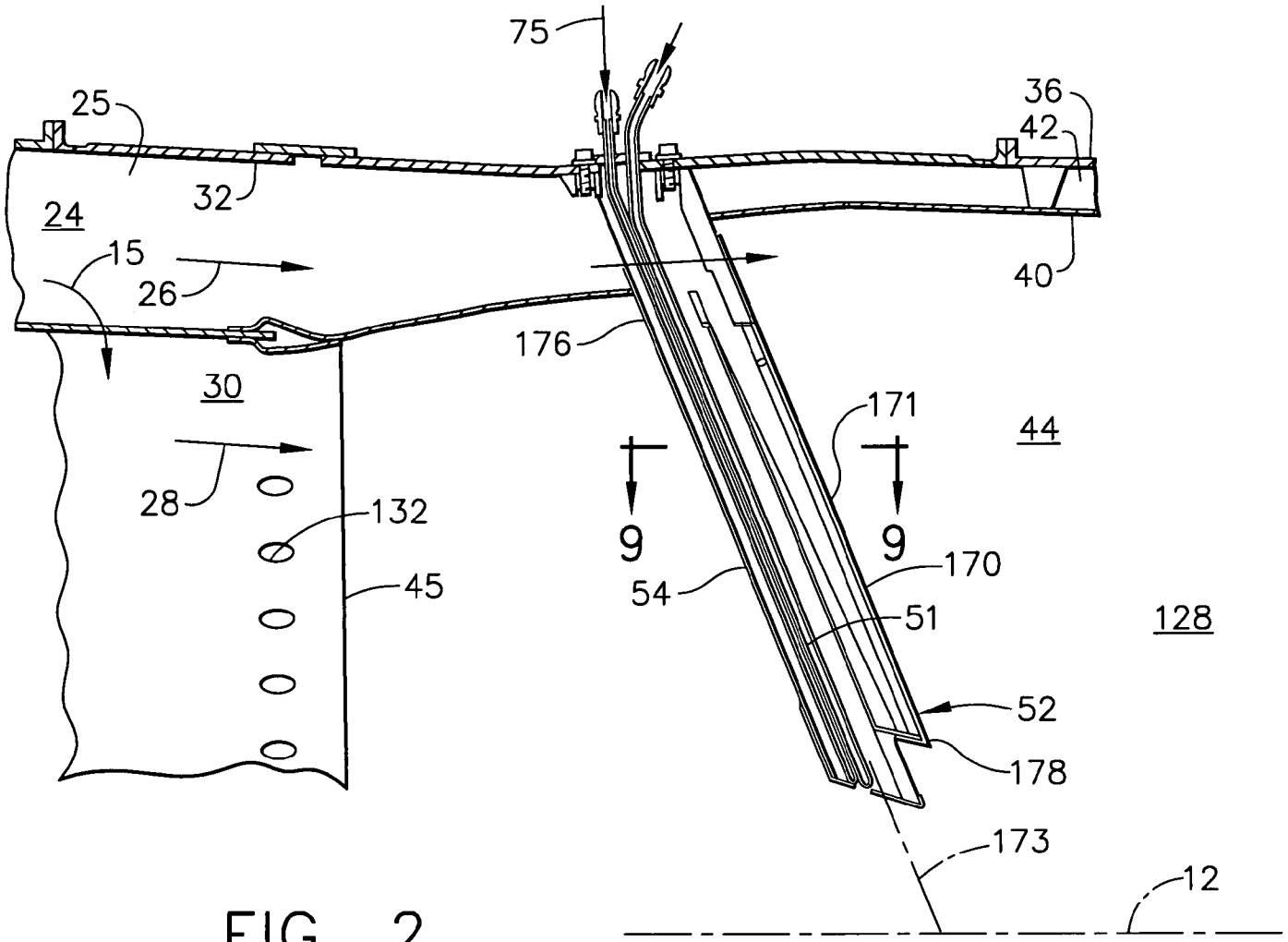
FIG. 2 is an enlarged axial sectional view illustration of a radial flameholder in the augmentor illustrated in FIG. 1.

Referring to FIGS. 1 and 2, exhaust vanes 45 extend radially across the exhaust flowpath 128. The exhaust vanes 45 are typically hollow and curved. The hollow exhaust vanes 45 are designed to receive a first portion 15 of the bypass air 26 and flow it into the exhaust flowpath 128 through air injection holes 132. The bypass air 26 and the core gases 28 mix together to form an exhaust flow 210. The exhaust section 126 includes an annular exhaust casing 36 disposed co-axially with and suitably attached to the corresponding engine casing 21 and surrounding the exhaust flowpath 128. Mounted to the aft end of the exhaust casing 36 is a conventional variable area converging-diverging exhaust nozzle 38 through which the exhaust flow 210 are discharged during operation.

Figure 4:
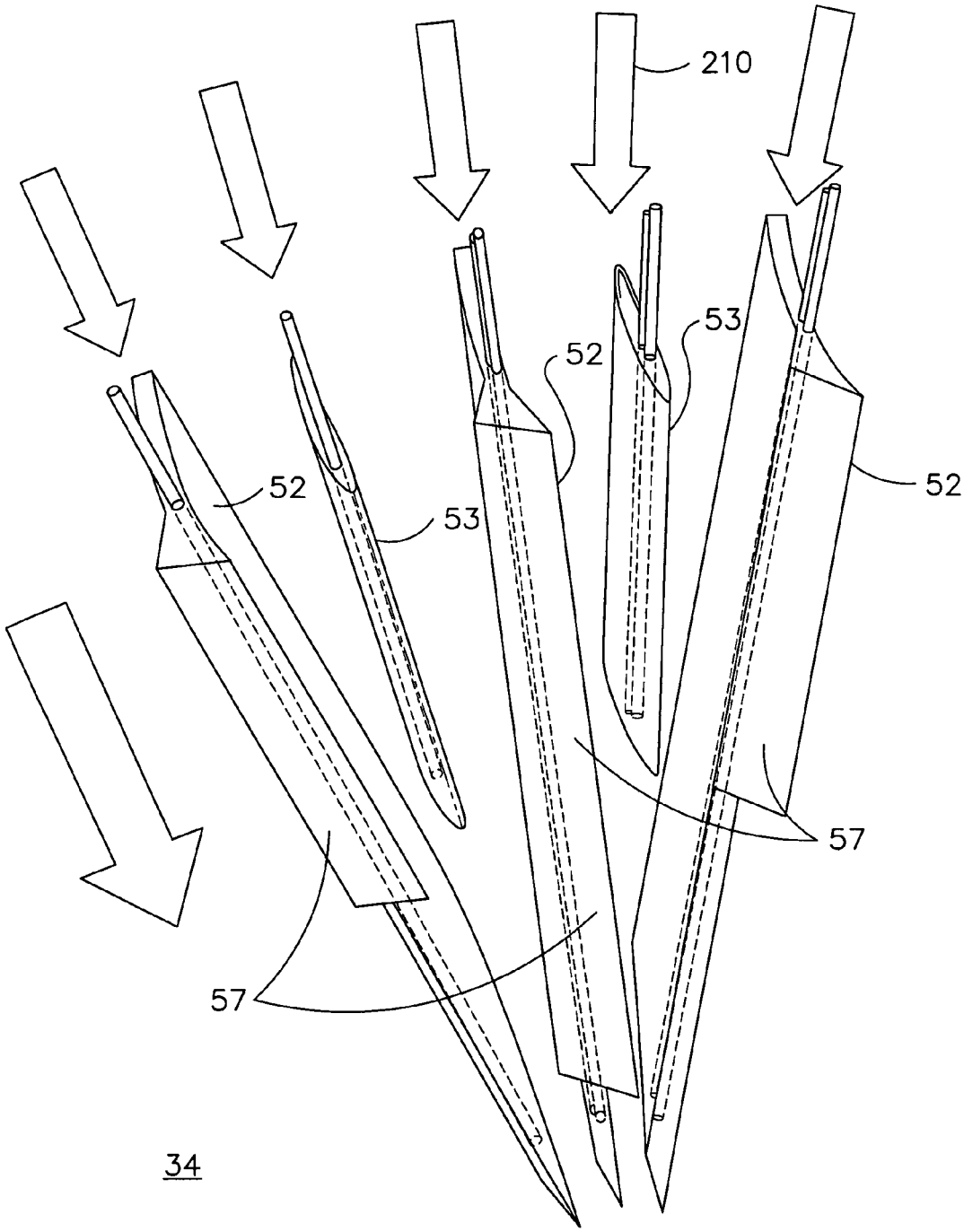
FIG. 4 is a perspective view illustration of a portion of the radial spray bars disposed between the radial flameholders in the augmentor illustrated in FIG. 3.

The exhaust section 126 further includes an annular exhaust combustion liner 40 spaced radially inwardly from the exhaust casing 36 to define therebetween an annular cooling duct 42 disposed in flow communication with the bypass duct 24 for receiving therefrom a second portion of the bypass air 26. An exhaust section combustion zone 44 within the exhaust flowpath 128 is located radially inwardly from the liner 40 and the bypass duct 24 and downstream or aft of the core engine 13 and the low pressure turbine 22. The exemplary embodiment of the augmentor 34 illustrated herein includes a plurality of circumferentially spaced apart radial flameholders 52 extending radially inwardly from the diffusion liner 46 into the exhaust flowpath 128 and circumferentially interdigitated with augmentor fuel radial spray bars 53, i.e. one radial spray bar 53 between each circumferentially adjacent pair 57 of the radial flameholders 52, as illustrated in FIG. 4.

Figure 3:
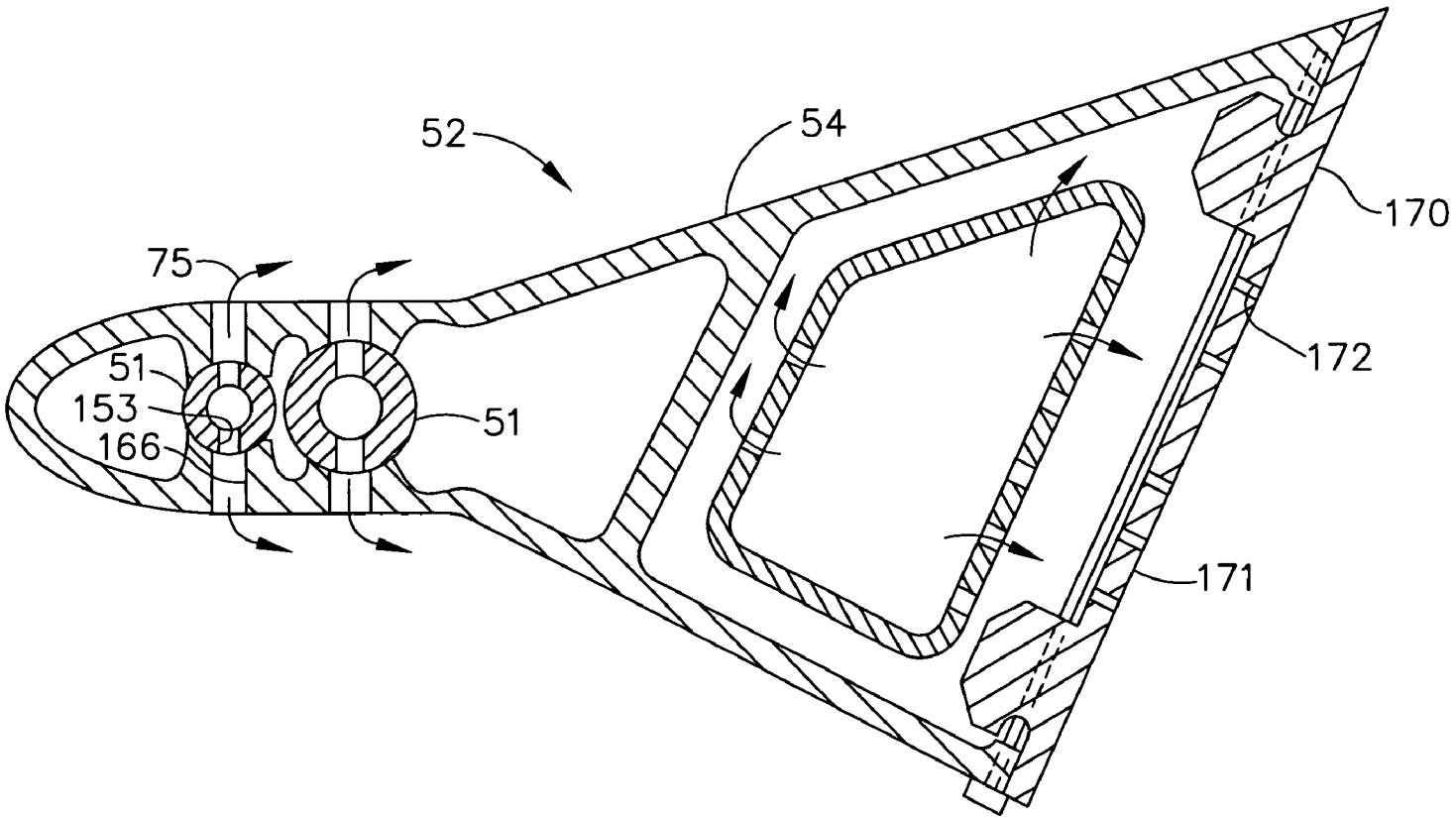
FIG. 3 is a sectional view illustration through the radial flameholder illustrated in FIG. 2.

Referring further to FIGS. 2 and 3, each radial flameholder 52 includes one or more flameholder fuel tubes 51 therein. The flameholder fuel tubes 51 are suitably joined in flow communication with a conventional fuel supply (not illustrated herein) which is effective for channeling fuel 75 to each of the flameholder fuel tubes for injecting the fuel 75 into the exhaust flowpath 128 downstream of the exhaust vanes 45 and upstream of the combustion zone 44. Similar air cooled flameholders are disclosed in detail in U.S. Pat. Nos. 5,813,221 and 5,396,763 both of which are assigned to the present assignee and incorporated herein by reference.

Each of the radial flameholders 52 include a flameholder heat shield 54 surrounding the flameholder fuel tubes 51. Fuel holes 153 in the flameholder fuel tubes 51 are operable for injecting fuel 75 through openings 166 in the flameholder heat shield 54 into the exhaust flowpath 128. A generally aft and downstream facing flameholding wall 170 having a flat outer surface 171 includes film cooling holes 172 and is located on an aft end of the flameholder heat shield 54. The radial flameholders 52 are swept downstream from radially outer ends 176 towards radially inner ends 178 of the radial flameholders as illustrated in FIG. 2. The flameholding wall 170 and the flat outer surface 171 are canted about a wall axis 173 that is angled with respect to the centerline axis 12 of the engine.

Referring again to FIG. 4, the augmentor fuel radial spray bars 53 are circumferentially disposed between at least some of the radial flameholders 52. The augmentor 34 is illustrated herein with one radial spray bar 53 between each circumferentially adjacent pair of the radial flameholders 52. Other embodiments of the augmentor 34 can employ more than one radial spray bar 53 between each radial flameholder 52. Yet other embodiments of the augmentor 34 can employ less radial spray bars 53 in which some of the adjacent pairs of the radial flameholders 52 have no radial spray bar 53 therebetween and others of the adjacent pairs of the radial flameholders 52 at least one radial spray bar 53 therebetween.

Figure 5:
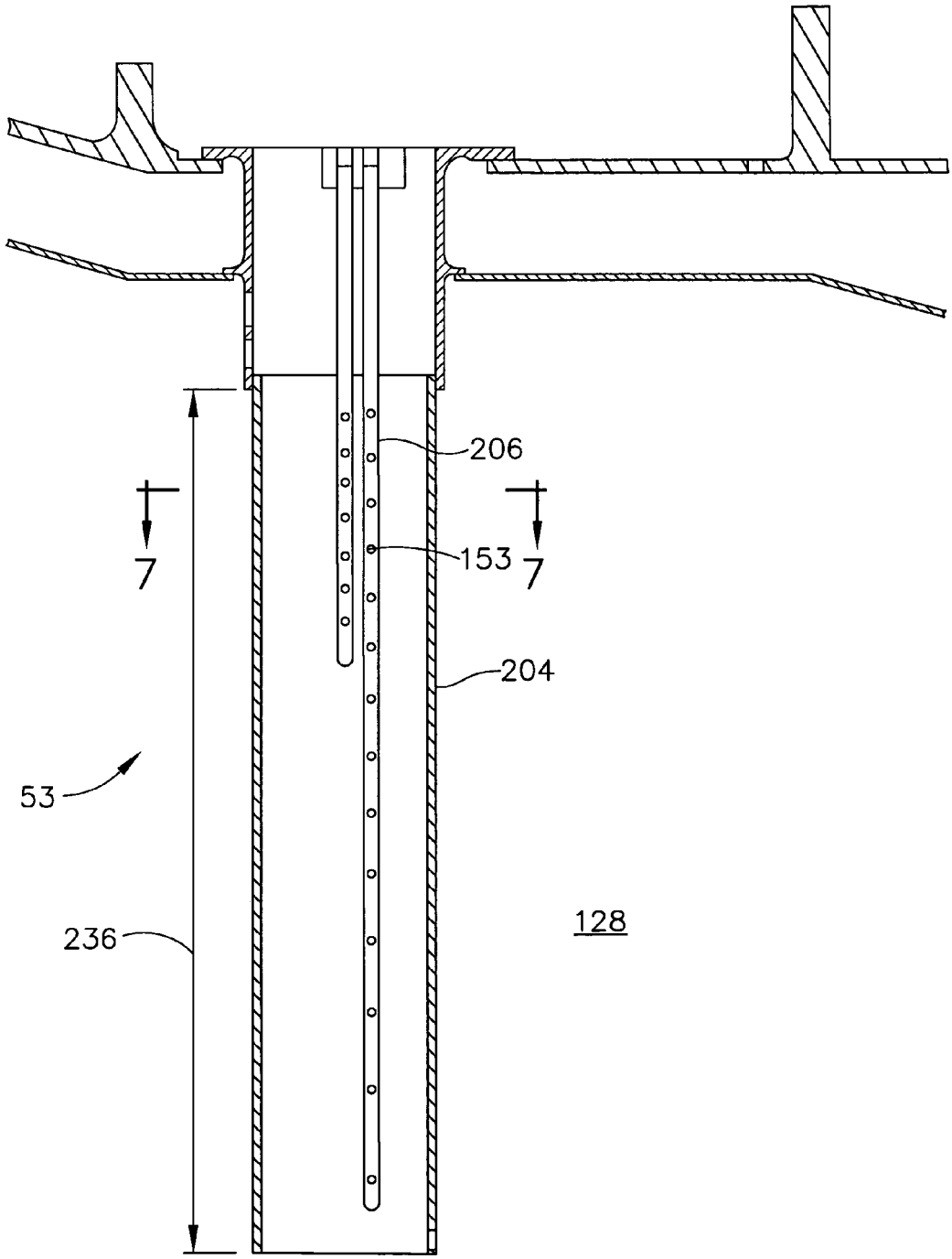
FIG. 5 is an enlarged axial sectional view illustration of the radial spray bar and cambered heat shield radial illustrated in FIG. 1.
Figure 6:
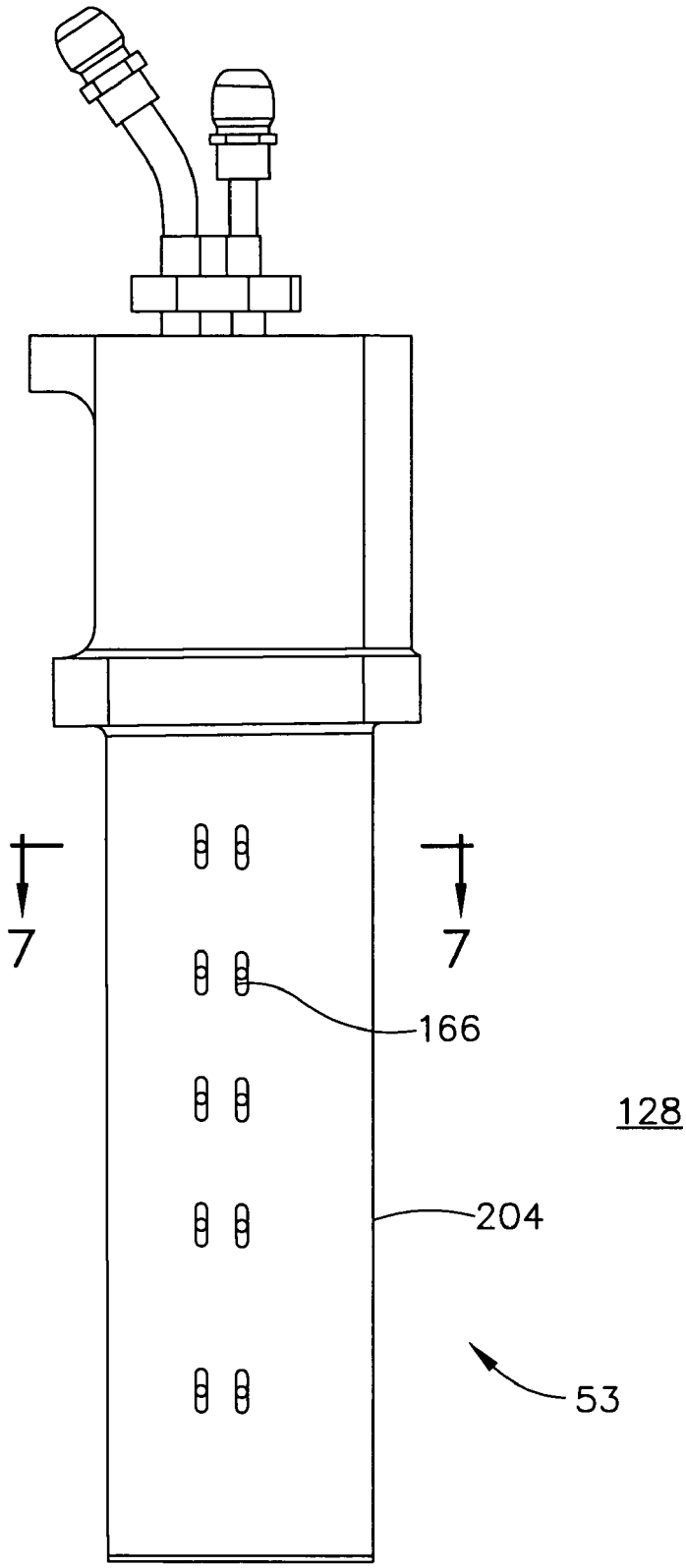
FIG. 6 is an enlarged elevational view illustration of the radial spray bar and cambered heat shield radial illustrated in FIG. 1.

Referring to FIGS. 5 and 6, each of the radial spray bars 53 includes a counterswirling spray bar heat shield 204 surrounding one or more spray bar fuel tubes 206. The radial spray bars 53 are illustrated herein as having two spray bar fuel tubes 206. Fuel holes 153 in the spray bar fuel tubes 206 are operable for injecting fuel 75 through openings 166 in the spray bar heat shields 204 into the exhaust flowpath 128. Referring back to FIGS. 1 and 2, the first portion 15 of the bypass air 26 mixes with core gases 28 in the exhaust flowpath 128 to form the exhaust flow 210 and further downstream with other portions of the bypass air 26. The augmentor 34 uses the oxygen in the exhaust flowpath 128 for combustion. The turbines and the exhaust vanes 45 impart swirl into the exhaust flow 210 passing through the augmentor 34. The spray bar heat shields 204 have counterswirling features to counter the swirl imparted into the exhaust flow 210.

Figure 7:
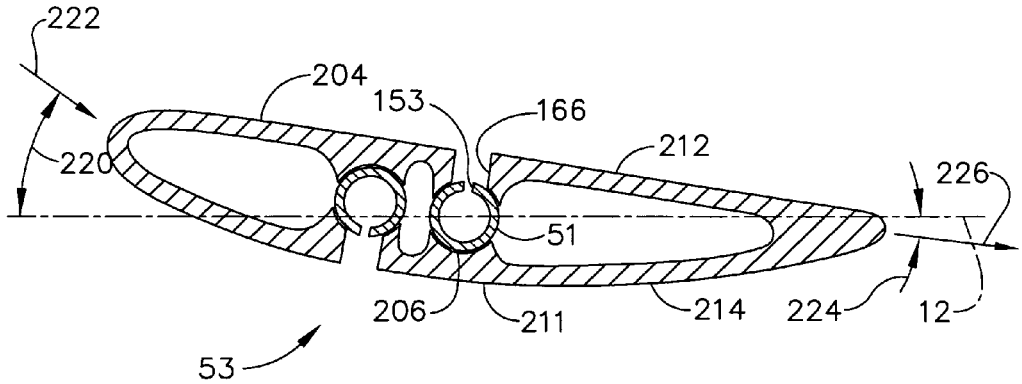
FIG. 7 is a sectional view illustration through 7-7 of the radial spray bar and cambered heat shield illustrated in FIG. 6.

A first counterswirling feature, illustrated in FIG. 7, is a cambered airfoil cross-section 211 of the spray bar heat shields 204. The cambered airfoil cross-section 211 includes pressure and suction sides 212 and 214 of the airfoil shaped spray bar heat shields 204. The cambered airfoil cross-section 211 is operable to counterswirl of an inlet flow 222 having an inlet flow swirl angle 220, an angle between an inlet flow 222 and the centerline axis 12, resulting in an outlet flow swirl angle 224 that is substantially 0 degrees and an outlet flow 226 substantially parallel to the centerline axis 12 of the engine. The outlet flow swirl angle 224 is an angle between the outlet flow 226 and the centerline axis 12. The degree or amount of camber may be constant or vary along a radial length 236 of the spray bar heat shields 204.

Figure 8:
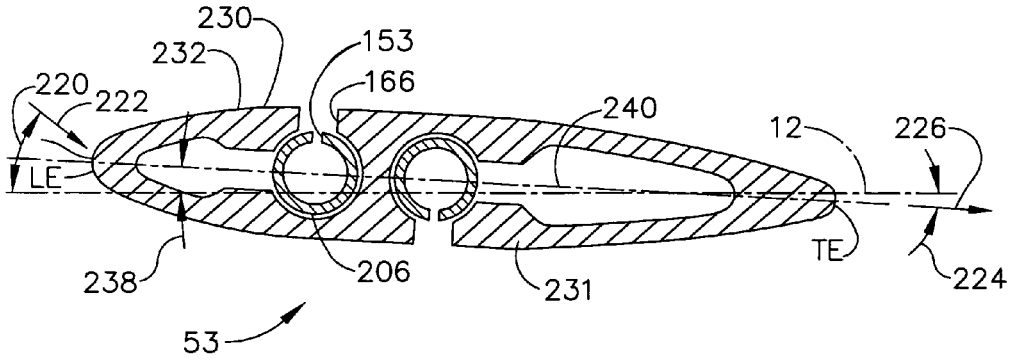
FIG. 8 is a sectional view illustration of an alternative to the radial spray bar illustrated in FIG. 7 having a twisted heat shield.

A second counterswirling feature, illustrated in FIG. 8, is a twisted airfoil 230 of the spray bar heat shields 204. The twisted airfoil 230 has a twisted airfoil cross-section 231 which may have a symmetrical airfoil shape 232. The twisted airfoil 230 is operable to counter the swirl of an inlet flow 222 having an inlet flow swirl angle 220, the angle between an inlet flow 222 and the centerline axis 12, resulting in an outlet flow swirl angle 224 that is substantially 0 degrees and an outlet flow 226 substantially parallel to the centerline axis 12 of the engine. A degree or amount of twist 238 of the twisted airfoil 230 may be constant or vary along the radial length 236 of the spray bar heat shields 204. The twist 238 is an angle between a chord 240 of the twisted airfoil cross-section 231, anywhere along the twisted airfoil 230, and the centerline axis 12. The twisted airfoil 230 is illustrated herein as being symmetrical about the chord 240 which extends from a leading edge LE to a trailing edge TE of the twisted airfoil 230. For example, the twisted airfoil 230 may have a constant twist 238 of three degrees along the radial length 236 of the spray bar heat shields 204.

In another example, the twisted airfoil 230 may have a twist 238 which varies linearly or otherwise from positive 1.5 degrees to a negative 1.5 degrees along the radial length 236 of the spray bar heat shields 204. For the twisted airfoil 230 with the varying twist 238 it might be better to have only one spray bar fuel tube 206 to more easily align the fuel holes 153 in the flameholder fuel tubes 51 with the openings 166 in the flameholder heat shield 54.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

What is claimed:

1. A gas turbine engine augmentor radial fuel spray bar comprising a counterswirling spray bar heat shield having a cambered airfoil cross-section for countering swirl in an exhaust flow of an augmentor; one or more spray bar fuel tubes within the counterswirling spray bar heat shield, openings in the spray bar heat shield, and fuel holes in the spray bar fuel tubes operable for injecting fuel through the openings.

2. An augmentor spray bar according to claim 1 further comprising the cambered airfoil cross-section having pressure and suction sides.

3. An augmentor spray bar according to claim 2 further comprising the cambered airfoil cross-section being operable to counterswirl an inlet flow having an inlet flow swirl angle resulting in an outlet flow swirl angle being substantially 0 degrees and an outlet flow substantially parallel to an augmentor centerline axis.

4. An augmentor spray bar according to claim 2 further comprising the cambered airfoil cross-section having a varying or constant degree of camber along a radial length of the spray bar heat shields.

5. A gas turbine engine augmentor radial fuel spray bar comprising: the a counterswirling spray bar heat shield having a twisted airfoil, the twisted airfoil having a twisted airfoil cross-section and a twist for countering swirl in an exhaust flow of a augmentor, the twist defined as an angle between a chord of the twisted airfoil cross-section and an augmentor centerline axis anywhere along the twisted airfoil, one or more spray bar fuel tubes within the counterswirling spray bar heat shield, openings in the spray bar heat shield, and fuel holes in the spray bar fuel tubes operable for injecting fuel through the openings.

6. An augmentor spray bar according to claim 5 further comprising the twisted airfoil being operable to counterswirl an inlet flow having an inlet flow swirl angle resulting in an outlet flow swirl angle being substantially 0 degrees and an outlet flow substantially parallel to an augmentor centerline axis.

7. An augmentor spray bar according to claim 5 further comprising the twisted airfoil having a varying or constant degree of twist along a radial length of the spray bar heat shields.

8. A gas turbine engine augmentor comprising:

a plurality of circumferentially spaced apart radial flameholders, a plurality of augmentor radial fuel spray bars, one or more of the augmentor radial fuel spray bars circumferentially disposed between one or more circumferentially adjacent pairs of the radial flameholders, and the spray bars having counterswirling spray bar heat shields having a cambered airfoil cross-section for countering swirl in an exhaust flow of an augmentor.

9. An augmentor according to claim 8 further comprising only one of the augmentor radial fuel spray bars disposed between each of the circumferentially adjacent pairs of the radial flameholders.

10. An augmentor according to claim 8 further comprising the cambered airfoil cross-section having pressure and suction sides.

11. An augmentor according to claim 8 further comprising the cambered airfoil cross-section being operable to counterswirl an inlet flow having an inlet flow swirl angle resulting in an outlet flow swirl angle being substantially 0 degrees and an outlet flow substantially parallel to an augmentor centerline axis.

12. An augmentor according to claim 10 further comprising the cambered airfoil cross-section having a varying or constant degree of camber along a radial length of the spray bar heat shields.

13. A gas turbine engine augmentor comprising:

a plurality of circumferentially spaced apart radial flameholders, a plurality of augmentor radial fuel spray bars, one or more of the augmentor radial fuel spray bars circumferentially disposed between one or more circumferentially adjacent pairs of the radial flameholders, the spray bars having counterswirling spray bar heat shields, and each of the counterswirling spray bar heat shields having a twisted airfoil.

14. An augmentor according to claim 13 further comprising the twisted airfoil being operable to counterswirl an inlet flow having an inlet flow swirl angle resulting in an outlet flow swirl angle being substantially 0 degrees and an outlet flow substantially parallel to an augmentor centerline axis.

15. An augmentor according to claim 13 further comprising the twisted airfoil having a varying or constant degree of twist along a radial length of the spray bar heat shields.

16. An augmentor according to claim 8 further comprising:

one or more spray bar fuel tubes within each of the counterswirling spray bar heat shields, openings in the spray bar heat shield, and fuel holes in the spray bar fuel tubes operable for injecting fuel through the openings.

17. An augmentor according to claim 16 further comprising the cambered airfoil cross-section having pressure and suction sides.

18. An augmentor according to claim 17 further comprising the cambered airfoil cross-section being operable to counterswirl an inlet flow having an inlet flow swirl angle resulting in an outlet flow swirl angle being substantially 0 degrees and an outlet flow substantially parallel to an augmentor centerline axis.

19. An augmentor according to claim 17 further comprising the cambered airfoil cross-section having a varying or constant degree of camber along a radial length of the spray bar heat shields.

20. A gas turbine engine augmentor comprising:

a plurality of circumferentially spaced apart radial flameholders having flat outer surfaces canted about a wall axis angled with respect to a centerline axis of the augmentor, a plurality of augmentor radial fuel spray bars, one or more of the augmentor radial fuel spray bars circumferentially disposed between one or more circumferentially adjacent pairs of the radial flameholders, the spray bars having counterswirling spray bar heat shields, and each of the counterswirling spray bar heat shields having a twisted airfoil.

21. An augmentor according to claim 20 further comprising the twisted airfoil being operable to counterswirl an inlet flow having an inlet flow swirl angle resulting in an outlet flow swirl angle being substantially 0 degrees and an outlet flow substantially parallel to an augmentor centerline axis.

22. An augmentor according to claim 20 further comprising the twisted airfoil having a varying or constant degree of twist along a radial length of the spray bar heat shields.

* * * * *